US009200401B2

(12) United States Patent
Chung et al.

(10) Patent No.: US 9,200,401 B2
(45) **Date of Patent: *Dec. 1, 2015**

(54) METHOD FOR CONTROLLING LAUNDRY TREATING APPARATUS

(71) Applicant: LG Electronics Inc., Seoul (KR)

(72) Inventors: Bosun Chung, Gyeongnam (KR); Yongwoon Jang, Gyeongnam (KR); Hoonbong Lee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 166 days.

This patent is subject to a terminal disclaimer.

(21) Appl. No.: 14/031,523

(22) Filed: Sep. 19, 2013

(65) Prior Publication Data

US 2014/0082958 A1 Mar. 27, 2014

(30) Foreign Application Priority Data

Sep. 24, 2012 (KR) ..... 10-2012-0105763

(51) Int. Cl.

*D06F 58/00* (2006.01)
*D06F 39/00* (2006.01)
*D06F 33/02* (2006.01)

(52) U.S. Cl.

CPC ..... *D06F 39/003* (2013.01); *D06F 33/02* (2013.01); *D06F 2202/10* (2013.01)

(58) Field of Classification Search

CPC ..... D06F 58/00; D06F 58/20; F26B 19/00; F26B 21/00; F26B 21/02
USPC ..... 34/349, 381, 413, 497; 68/49, 20; 8/149, 159
See application file for complete search history.

(56) References Cited

U.S. PATENT DOCUMENTS

| | | | | |
|---|---|---|---|---|
| 4,517,695 | A * | 5/1985 | Hoffmann et al. | 8/158 |
| 5,737,852 | A * | 4/1998 | Shukla et al. | 34/528 |
| 5,899,005 | A * | 5/1999 | Chen et al. | 34/528 |
| 6,098,310 | A | 8/2000 | Chen | |
| 6,931,759 | B2 * | 8/2005 | Jeong et al. | 34/485 |
| 7,503,127 | B2 * | 3/2009 | DuVal et al. | 34/381 |
| 7,900,374 | B2 * | 3/2011 | Bae et al. | 34/491 |
| 8,104,191 | B2 * | 1/2012 | Ricklefs et al. | 34/474 |

(Continued)

FOREIGN PATENT DOCUMENTS

| | | | | |
|---|---|---|---|---|
| GB | 2012934 A | * | 8/1979 | F26B 23/00 |
| JP | 10090171 A | * | 4/1998 | G01N 21/35 |

(Continued)

OTHER PUBLICATIONS

Australian Office Action dated Mar. 26, 2015 for Australian Application No. 2013228847, 5 pages.

(Continued)

*Primary Examiner* — Stephen M Gravini
(74) *Attorney, Agent, or Firm* — Fish & Richardson P.C.

(57) ABSTRACT

Control of a laundry treating apparatus, in which at least one of a dryness level and a percentage of water content of laundry received in a drum of the laundry treating apparatus is determined. A determination is made as to whether the laundry in the drum includes water-filled laundry based on at least one of the dryness level and the percentage of water content of the laundry in the drum. Dehydration drying of the laundry in the drum is controlled based on the determination of whether the laundry in the drum includes water-filled laundry.

22 Claims, 9 Drawing Sheets

(56) References Cited

U.S. PATENT DOCUMENTS

| | | | | |
|---|---|---|---|---|
| 8,136,264 | B2 * | 3/2012 | Bae et al. | 34/381 |
| 8,250,776 | B2 * | 8/2012 | Yoo et al. | 34/486 |
| 8,418,378 | B2 * | 4/2013 | Nawrot et al. | 34/486 |
| 8,544,187 | B2 * | 10/2013 | Choi et al. | 34/407 |
| 8,549,770 | B2 * | 10/2013 | Bellinger et al. | 34/486 |
| 8,561,320 | B2 * | 10/2013 | Geer et al. | 34/491 |
| 8,707,580 | B2 * | 4/2014 | Hopkins | 34/527 |
| 8,769,840 | B2 * | 7/2014 | Dondurur et al. | 34/60 |
| 8,869,421 | B2 * | 10/2014 | Kim et al. | 34/381 |
| 2004/0045187 | A1 * | 3/2004 | Curry et al. | 34/595 |
| 2004/0200093 | A1 | 10/2004 | Wunderlin | |
| 2009/0106913 | A1 * | 4/2009 | Suel et al. | 8/159 |
| 2012/0124859 | A1 * | 5/2012 | May et al. | 34/572 |
| 2014/0082958 | A1 * | 3/2014 | Chung et al. | 34/319 |
| 2014/0082959 | A1 * | 3/2014 | Oh et al. | 34/319 |
| 2015/0047219 | A1 * | 2/2015 | Lee et al. | 34/282 |
| 2015/0051738 | A1 * | 2/2015 | Lee et al. | 700/275 |

FOREIGN PATENT DOCUMENTS

| | | | | |
|---|---|---|---|---|
| JP | 2004-242430 | A | | 8/2004 |
| JP | 2008307416 | A | * | 12/2008 |
| JP | 2010088700 | A | * | 4/2010 |
| JP | 2012130478 | A | * | 7/2012 |

OTHER PUBLICATIONS

Chinese Office Action dated May 6, 2015 for Chinese Application No. 201310439155.0, with English Translation, 19 pages.

* cited by examiner

METHOD FOR CONTROLLING LAUNDRY TREATING APPARATUS

This application claims the benefit of Korean Patent Application No. 10-2012-0105763, filed on Sep. 24, 2012, which is hereby incorporated by reference as if fully set forth herein.

FIELD

The present disclosure relates to a method for controlling a laundry treating apparatus.

BACKGROUND

Depending on functions of treating laundry, laundry treating apparatuses can generally be classified into a washing machine and a dryer. A washing machine performs a washing operation of removing contaminants from the laundry using washing water, and a dryer performs a dehydration drying operation of removing moisture from the laundry. Recently, a washing machine provided with an integrated dehydration drying function is under development.

Also, laundry treating apparatuses can be classified into a top loading type and a front loading type. In the case of the top loading type, the introduction port through which the laundry is introduced is provided on the top of the cabinet. In the case of the front loading type, the introduction port through which the laundry is introduced is provided at the front side (or lateral side) of the cabinet.

The top loading type laundry treating apparatus includes a cabinet forming the external appearance of the laundry treating apparatus, and a drum and a tub provided in the cabinet. In the case of the top loading type laundry treating apparatus, the drum and the tub are arranged perpendicular to the ground, and the drum rotates about a rotating shaft perpendicular to the ground. In addition, positioned at the top of the cabinet are a laundry introduction port through which laundry is introduced, and a door to open and close the laundry introduction port.

SUMMARY

In one aspect, a method for controlling a laundry treating apparatus includes determining at least one of a dryness level and a percentage of water content of laundry received in a drum of the laundry treating apparatus and determining whether the laundry in the drum includes water-filled laundry based on at least one of the dryness level and the percentage of water content of the laundry in the drum. The method also includes controlling dehydration drying of the laundry in the drum based on the determination of whether the laundry in the drum includes water-filled laundry.

Implementations may include one or more of the following features. For example, the method may include determining the dryness level of laundry received in the drum of the laundry treating apparatus, comparing the dryness level of laundry received in the drum of the laundry treating apparatus to a reference dryness level, and, based on comparison results, determining that the dryness level of laundry received in the drum of the laundry treating apparatus meets the reference dryness level. In this example, the method may include, based on the determination that the dryness level of laundry received in the drum of the laundry treating apparatus meets the reference dryness level, determining that the laundry received in the drum of the laundry treating apparatus does not include water-filled laundry and conducting a dehydration drying operation based on the determination that the laundry received in the drum of the laundry treating apparatus does not include water-filled laundry.

In some examples, the method may include measuring an amount of the laundry in the drum in an environment in which the drum is not filled with water, accelerating the drum to a reference revolutions per minute (RPM), measuring inertia of the laundry in the drum based on acceleration of the drum to the reference RPM, and calculating the dryness level using the measured amount of the laundry in the drum and the measured inertia. In these examples, the method may include measuring the amount of the laundry in the drum prior to a washing operation of removing contaminants from the laundry. Further, in these examples, the method may include measuring an initial-amount-of-laundry current that represents a total current consumed to maintain the drum at a certain speed for sensing of an initial amount of laundry for a certain time and setting the amount of the laundry in the drum based on the initial-amount-of-laundry current.

In some implementations, the method may include measuring a first amount of dehydrated laundry in the drum after draining water from the drum following a rinsing operation that removes a detergent from the laundry. In these implementations, the method may include measuring a first-amount-of-dehydrated-laundry current that represents a total current consumed to maintain the drum at a certain speed for sensing of the first amount of dehydrated laundry for a certain time and setting the first amount of dehydrated laundry in the drum based on the first-amount-of-dehydrated-laundry current.

Also, the method may include measuring a first acceleration current that represents a total current consumed to accelerate the drum including supersaturated laundry at a first acceleration rate for a certain time. The method may include setting the amount of the laundry in the drum based on the first acceleration current.

In some examples, the method may include accelerating the drum including the laundry upon which a rinsing operation has been completed to a first RPM, decelerating the drum to a second RPM lower than the first RPM, measuring a reference current that represents a total current consumed to accelerate the drum from the second RPM at a reference acceleration rate for a reference time, and setting the inertia of the laundry in the drum based on the reference current. In these examples, the method may include, during acceleration of the drum including the laundry upon which the rinsing operation has been completed to the first RPM, measuring a first acceleration current that represents a total current consumed to accelerate the drum including supersaturated laundry at a first acceleration rate for a certain time and setting the amount of the laundry in the drum based on the first acceleration current. Further, in these examples, measuring the first acceleration current may be conducted in a range of rate of rotation lower than the second RPM.

In some implementations, the method may include determining the percentage of water content of laundry received in the drum of the laundry treating apparatus, comparing the percentage of water content of laundry received in the drum of the laundry treating apparatus to a reference percentage of water content, and, based on comparison results, determining that the percentage of water content of laundry received in the drum of the laundry treating apparatus does not meet the reference percentage of water content. In these implementations, the method may include, based on the determination that the percentage of water content of laundry received in the drum of the laundry treating apparatus does not meet the reference percentage of water content, determining that the laundry received in the drum of the laundry treating apparatus does not include water-filled laundry and conducting a dehydration drying operation based on the determination that the laundry received in the drum of the laundry treating apparatus does not include water-filled laundry.

In some examples, the method may include, prior to a washing operation of removing contaminants from the laundry in the drum, measuring an initial amount of the laundry in the drum, measuring a first amount of dehydrated laundry after draining water from the drum following a rinsing operation that removes a detergent from the laundry, and calculating the percentage of water content using the initial amount of laundry and the first amount of dehydrated laundry. In these examples, the method may include measuring an initial-amount-of-laundry current that represents a total current consumed to maintain the drum at a certain speed for sensing of the initial amount of laundry for a certain time and setting the initial amount of the laundry in the drum based on the initial-amount-of-laundry current.

In addition, the method may include measuring a first-amount-of-dehydrated-laundry current that represents a total current consumed to maintain the drum at a certain speed for sensing of the first amount of dehydrated laundry for a certain time and setting the first amount of dehydrated laundry based on the first-amount-of-dehydrated-laundry current. Further, the method may include measuring a first acceleration current that represents a total current consumed to accelerate the drum including supersaturated laundry at a first acceleration rate for a certain time and setting the first amount of dehydrated laundry based on the first acceleration current.

In some implementations, a range of the dryness level may be divided into a plurality of dryness level sections that correspond to a different rate of rotation of the drum in each of the dryness level sections, and the method may include determining, from among the plurality of dryness level sections, a dryness level section based on the dryness level of laundry received in the drum of the laundry treating apparatus and conducting the dehydration drying operation using a rate of rotation of the drum that corresponds to the determined dryness level section. In these implementations, the rate of rotation of the drum may be determined such that the rate of rotation is in proportion to the dryness level.

In some examples, the method may include determining the dryness level of laundry received in the drum of the laundry treating apparatus, comparing the dryness level of laundry received in the drum of the laundry treating apparatus to a reference dryness level, and, based on comparison results, determining that the dryness level of laundry received in the drum of the laundry treating apparatus does not meet the reference dryness level. In these examples, the method may include, based on the determination that the dryness level of laundry received in the drum of the laundry treating apparatus does not meet the reference dryness level, determining that the laundry received in the drum of the laundry treating apparatus includes water-filled laundry and performing an operation directed to eliminating water-filled laundry from the drum.

In some implementations, the method may include counting a number of times of determining that the dryness level does not meet the reference dryness level, comparing the number of times to a reference number, and, based on the comparison of the number of times to the reference number, determining whether the number of times meets the reference number. In these implementations, the method may include terminating a dehydration drying operation based on a determination that the number of times meets the reference number and, based on a determination that the number of times does not meet the reference number, repeating the operation directed to eliminating water-filled laundry from the drum and repeating determination of the dryness level of laundry received in the drum of the laundry treating apparatus.

The operation directed to eliminating water-filled laundry from the drum may include performing at least one of forward rotation and reverse rotation of the drum in an attempt to untangle laundry in the drum. Also, the operation directed to eliminating water-filled laundry from the drum may include supplying washing water to a tub prior to performing at least one of forward rotation and reverse rotation of the drum in an attempt to untangle laundry in the drum.

DETAILED DESCRIPTION

The laundry treating apparatus described throughout may be applicable to washing machines including a dehydration drying function. The laundry treating apparatus may be applicable to both the top loading type provided with an introduction port for introduction of laundry at the upper portion of the cabinet and the front loading type provided with an introduction port for introduction of laundry at the front (or side) of the cabinet.

Hereinafter, a description will be given of a top loading type washing machine as an example of the laundry treating apparatus. However, the laundry treating apparatus may be applicable to a front loading type washing machine, and even to a laundry treating apparatus having a dehydration drying function, such as a dehydration machine having only the dehydration drying function and a dryer having the drying function.

Figure 1:
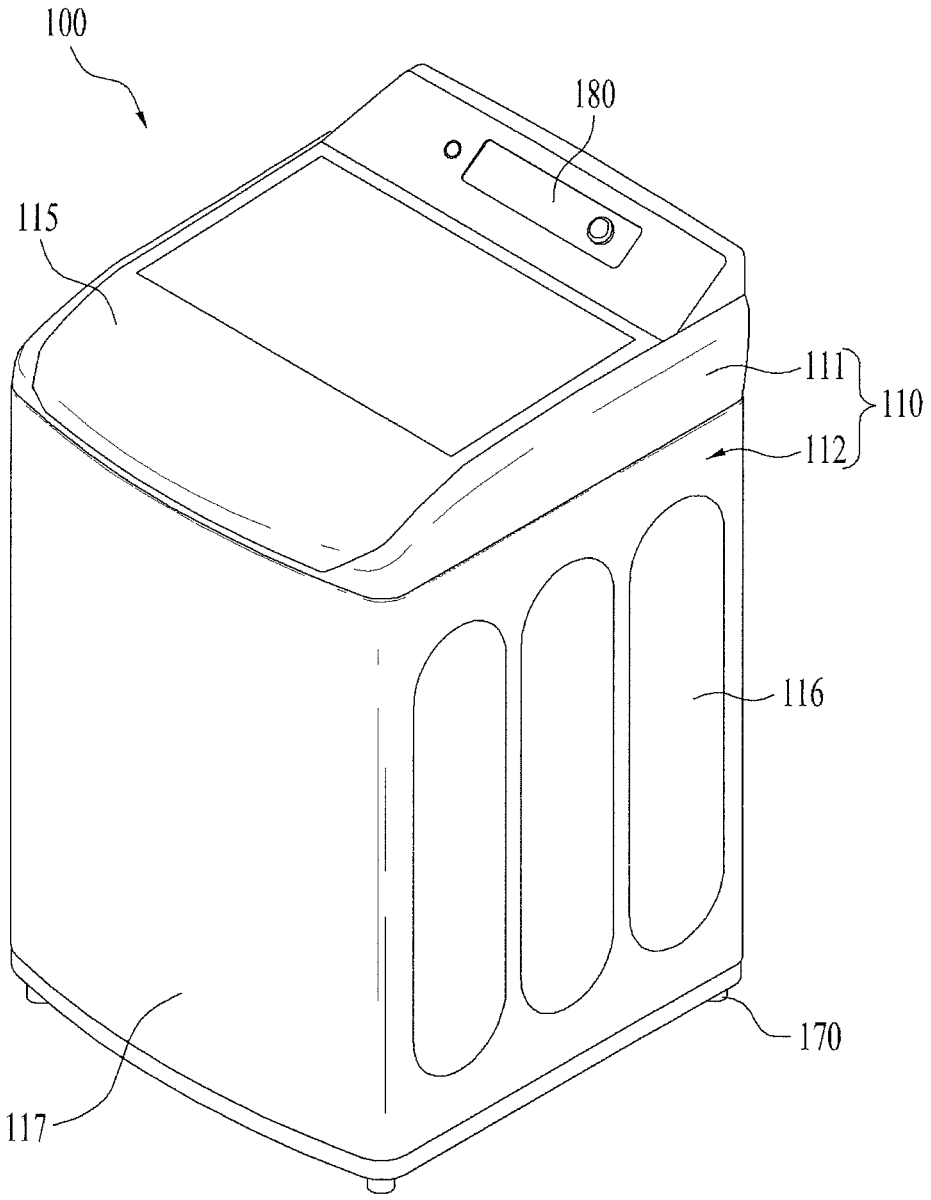
FIG. 1 is a perspective view illustrating an example laundry treating apparatus.
Figure 2:
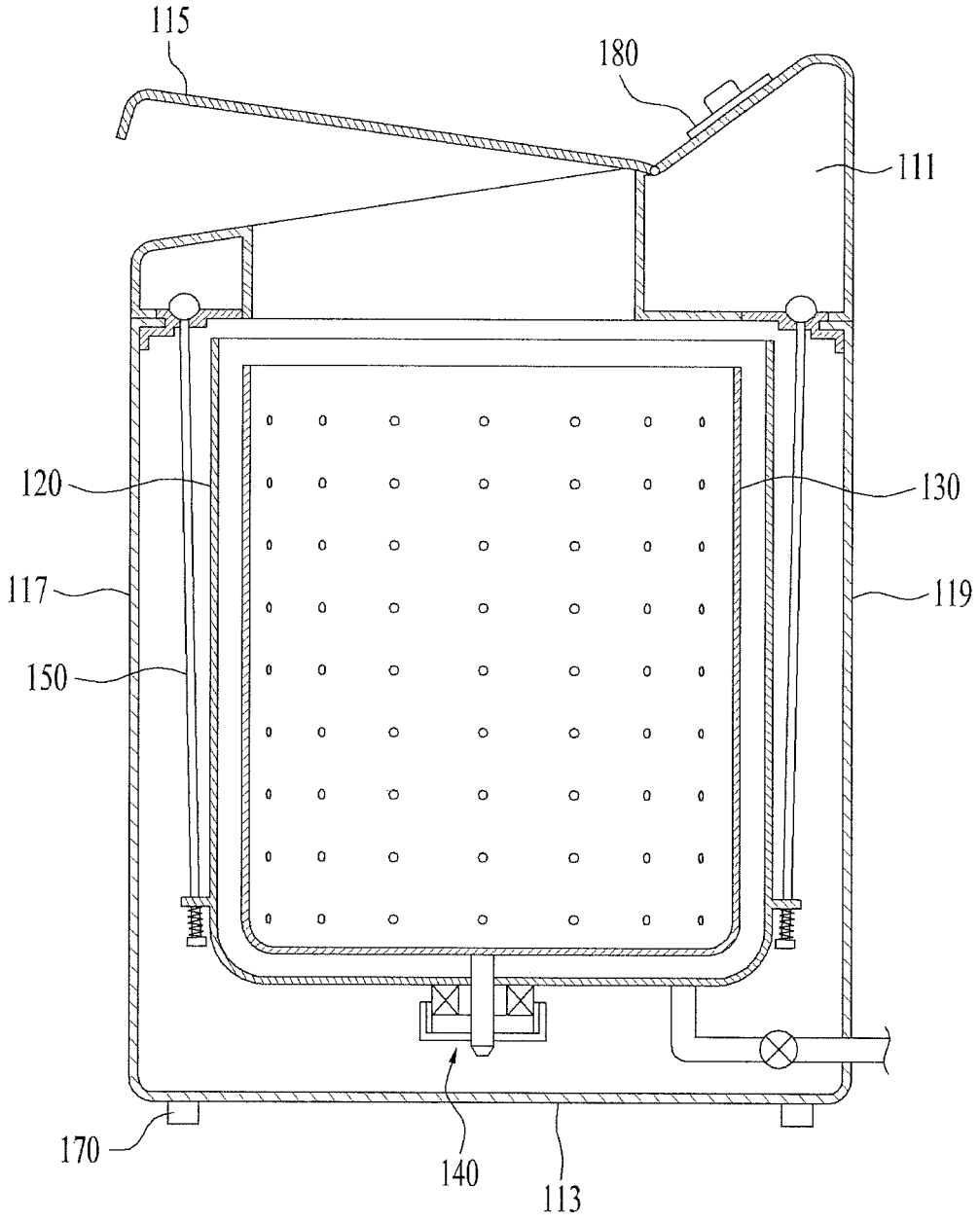
FIG. 2 is a lateral cross-sectional view illustrating the example laundry treating apparatus.

Referring to FIGS. 1 and 2, an example washing machine 100 may include a cabinet 110 forming a body of the washing machine. In addition, provided in the cabinet 110 is a tub 120 to store washing water. Moreover, a drum 130 provided with a plurality of through holes is rotatably installed in the tub 120. In addition, a drive motor 140 to rotate the drum 130 is provided on the bottom surface of the tub 120. The tub 120 is supported by the cabinet 110 by a suspension 150.

In addition, the cabinet 110 includes a lower cabinet 112 having an open upper portion and a top cover 111 coupled to the open upper portion of the lower cabinet 112.

The lower cabinet 112 may include a side panel 116, a front panel 117, a base 113, and a rear panel 119. Herein, the side panel 116, the front panel 117, the base 113 and the rear panel 119 may be integrated.

The top cover 111 is coupled to the open upper portion of the lower cabinet 112 to define a closed space in which the tub 120 and the drum 130 are provided. The top cover 111 is provided with a laundry introduction port through which laundry may be introduced. In addition, the top cover 111 is provided with a door 115 to open and close the laundry introduction port. In addition, provided to one side of the top cover 111 is a control panel 180 through which operations, such as a washing operation are input. The user may control the washing machine through the control panel 180. That is, the user is allowed to select the washing operation or control start and termination of the washing operation and driving of the washing machine through an input unit provided to the control panel 180. Meanwhile, a leg 170 to support the cabinet 110 is provided on the bottom surface of the cabinet 110. The leg 170 may be arranged at the lower portion of the base 113.

Figure 3:
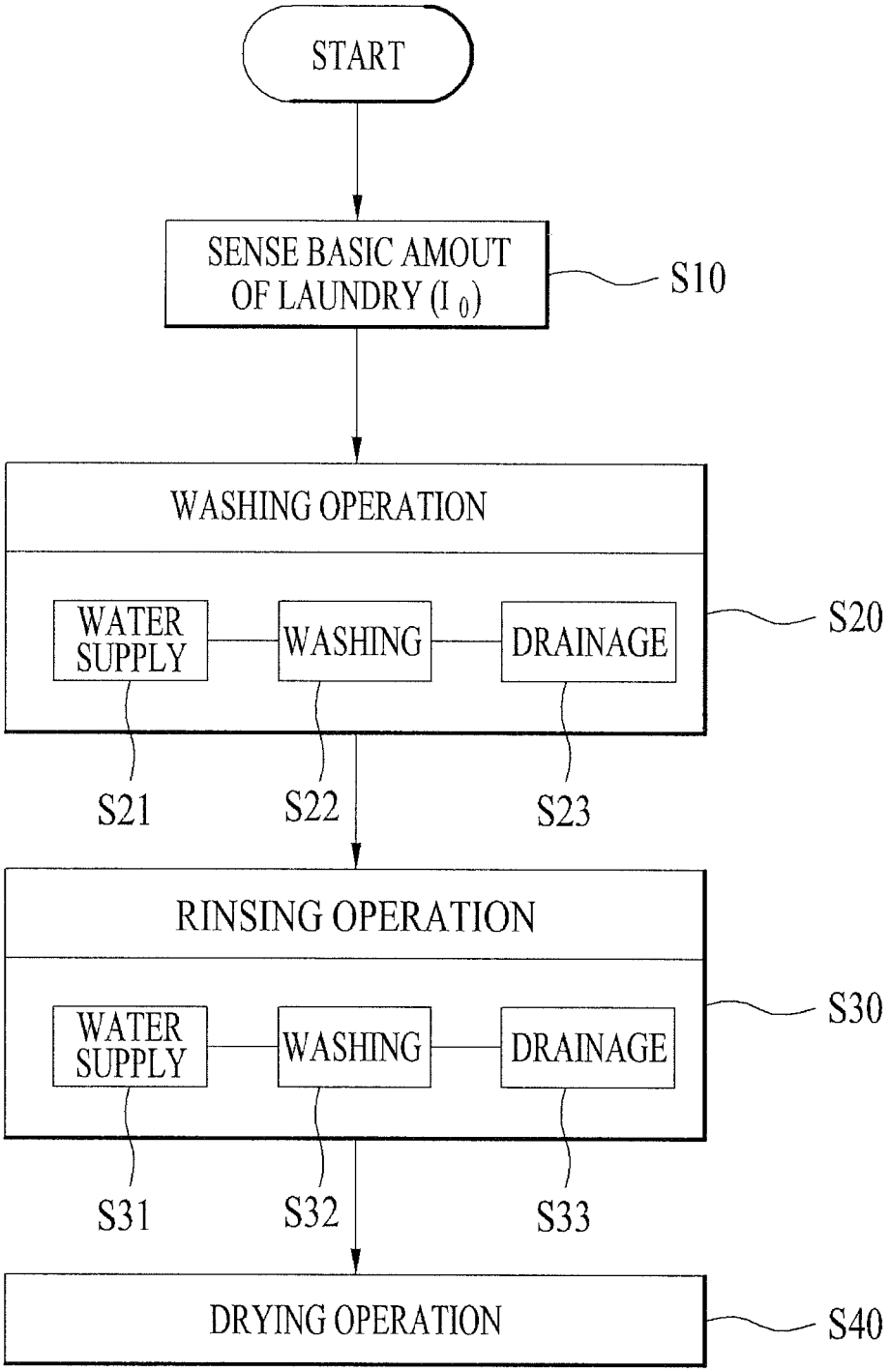
FIG. 3 is a flowchart illustrating an example method for controlling a laundry treating apparatus.

Referring to FIG. 3, an example method for controlling a washing machine may include a washing operation S20 of washing contaminated laundry using, for example, a detergent. The method may further include a rinsing operation S30 of removing detergent from the laundry upon which the washing operation S20 has been completed. The method may further include a dehydration drying operation S40 of removing moisture from the laundry for which the rinsing operation S30 has been completed. The method may further include a step of sensing an amount of laundry S10. The sensing operation 10 may include sensing the amount of laundry in the drum (hereinafter, the amount of laundry) before the washing operation S20 is conducted.

In the washing operation S20, contaminants are removed from the contaminated laundry using washing water. Specifically, the washing operation S20 includes a water supply step S21, a washing step S22, and a draining step S23. In the water supply step S21, washing water from a water source is supplied to the tub. In the washing step S22, the drum is rotated to remove contaminants from the laundry. In the washing step S22, contaminants may be separated from the laundry during forward and reverse rotation of the drum. In addition, in the washing step S22, a detergent functioning to separate contaminants from the laundry may be supplied to the drum. When the washing step S22 is terminated, the drainage step S23 of discharging the washing water from the washing machine is conducted. In the drainage step S23, the washing water may be discharged from the tub using a drainage pump. In the washing operation S20, the water supply step S21, the washing step S22 and the drainage step S23 may be conducted at least once. Depending on the amount of laundry or the degree of contamination of the laundry, the number of repetitions of the water supply step S21, the washing step S22, and the drainage step S23 may vary.

The rinsing operation S30 is a step of removing the detergent and contaminants from the laundry upon which the washing operation S20 has been completed. Specifically, the rinsing operation S30 includes a water supply step S31, a rinsing step S32, and a drainage step S33. The water supply step S31 is a step of receiving washing water from a water source and supplying the same to the tub. The rinsing step S32 is a step of removing the detergent and contaminants from the laundry by rotating the drum. In the rinsing step S32, the detergent and contaminants may be separated from the laundry during forward and reverse rotation of the drum. In addition, in the rinsing step S32, a fabric softener may be supplied into the drum. The fabric softener functions to produce electrostatic charges in the laundry and to soften the laundry. When the rinsing step S32 is completed, the drainage step S33 of discharging the washing water from the washing machine is conducted. In the drainage step S33, the washing water may be discharged from the tub using the drainage pump. In the rinsing operation S30, the water supply step S31, the rinsing step S32 and the drainage step S33 may be conducted at least once. Depending on the amount of laundry or the degree of contamination of the laundry, the number of repetitions of the water supply step S31, the rinsing step S32, and the drainage step S33 may vary.

The dehydration drying operation S40 is an operation of removing moisture from the laundry. During the dehydration drying operation S40, moisture is removed from the laundry using centrifugal force produced by rotating the drum at high speed. The dehydration drying operation S40 will be described in more detail later.

Further, before the washing operation S20 is performed according to a washing course selected through the control panel 180 by the user, the step of sensing the amount of laundry S10 in the drum 130 may be performed. Alternatively, the step of sensing the amount of laundry S10 may be performed after the drainage step S33 of the rinsing operation S30 is completed.

The step of sensing the amount of laundry S10 is a step of sensing the amount of the laundry in the drum 130. The amount of the laundry may be sensed using various methods.

The methods of sensing the amount of laundry may be divided into sensing the amount of laundry using inertia and sensing the amount of laundry using an electrode sensor.

The method of sensing using inertia is based on the fact that a larger amount of laundry in the drum 130 has a greater inertia, and as the inertia increases, the power or current and the time taken to accelerate or decelerate the drum 130 increase.

In an example of the method of sensing using the magnitude of inertia, the time taken to accelerate the drum 130 to a certain speed may be measured. In the case that a large amount of laundry is in the drum 130, a large amount of time may be taken for the drum 130 to reach the certain speed. In the case that a small amount of laundry is in the drum 130, a small amount of time may be taken for the drum 130 to reach the certain speed. The correlation between the lead time and the amount of laundry may be stored in the form of a table in the controller or memory of the washing machine.

In another example, the current consumed to accelerate the drum 130 to a certain speed may be measured. At this time, the current may be measured for a certain time. In the case that a large amount of laundry is in the drum 130, a large amount of power is consumed to accelerate the drum 130 to a certain speed. In the case that a small amount of laundry is in the drum 130, a small amount of power is consumed. The correlation between the consumed amount of power and the amount of laundry may be stored in the form of a table in the controller or memory of the washing machine.

In a further example, the amount of laundry may be measured using the current consumed to maintain the drum 130 at a certain speed for a certain time, and the time taken to accelerate the drum 130 to a certain speed and then decelerate the drum to a speed below the certain speed or stop the drum.

In the method of sensing using an electrode sensor, the amount of laundry may be measured according to various commonly known technologies including those described in Korean Patent Application Publication Nos. 10-2006-0034062, 10-2006-0034064 and 10-2006-0022301.

When the laundry configured with fabric having a waterproof function is washed, washing water is sometimes accumulated in the laundry. Due to the waterproof function of the laundry, the washing water may permeate the laundry during the washing operation and remain present in the laundry without being discharged through the dehydration drying operation S40. That is, laundry having the waterproof function acts like a balloon containing water, and thus the washing water therein is sometimes prevented from flowing to the outside (hereinafter, the washing water remaining in the laundry will be referred to as 'the water balloon' or 'water-filled laundry'). Particularly, in the case that the drum 130 containing water-filled laundry is rotated at high speed during the dehydration drying operation S40, maldistribution of the laundry occurs in the drum 130 as the water-filled laundry is eliminated. When maldistribution of the laundry is sensed at the initial stage of the dehydration drying operation, the maldistribution in the drum 130 is measured with the water-filled laundry, and the operation of correcting the maldistribution is conducted. However, the dehydration drying operation may be conducted even though the water-filled laundry has not been addressed in this maldistribution elimination operation. That is, the controller of the washing machine performs the dehydration drying operation, considering the situation in which the water-filled laundry is present as having no maldistribution. In the case that the dehydration drying operation is performed in this state and the water balloon effect is eliminated during the dehydration drying operation, maldistribution of the laundry may occur due to elimination of the water balloon effect. The maldistribution caused by elimination of the water balloon effect may cause vibration and noise during rotation of the drum 130. Such vibration may cause the drum 130 to collide with the tub 120. In particular, the maldistribution occurring during the dehydration drying operation, in which the drum 130 is rotated at high speed, may increase impact applied to the drum 130 and the tub 120, even with only slight maldistribution. In addition, due to the impact, the door provided to the top cover may be separated from the top cover or the top cover itself may be separated from the cabinet.

In some implementations, the amount of water-filled laundry is sensed in the dehydration drying operation S40, and maldistribution and vibration are reduced (e.g., prevented) from occurring due to elimination of the water balloon effect.

Figure 4:
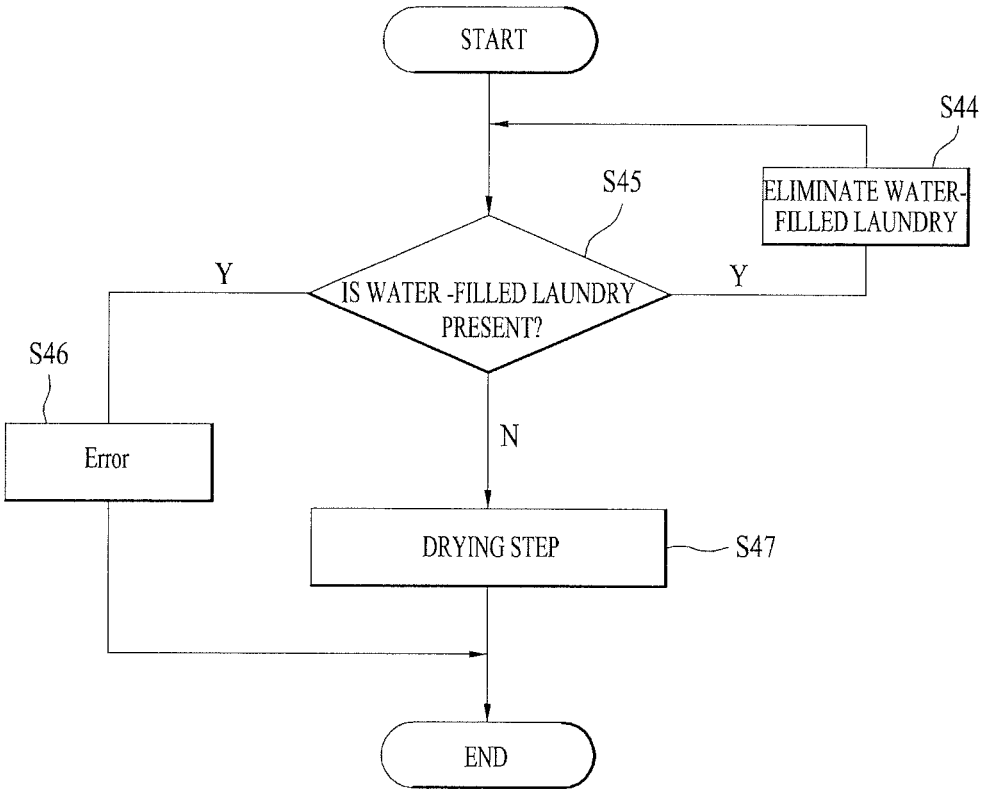
FIG. 4 is a flowchart illustrating an example dehydration drying operation in an example method for controlling a laundry treating apparatus.

Referring to FIG. 4, an example dehydration drying operation S40 of the example method for controlling a washing machine includes a water-filled laundry determining step S45 of determining whether the laundry contains water-filled laundry. The dehydration drying operation S40 further includes a dehydration drying step S47 of rotating the drum and dehydration drying the laundry when it is determined in the water-filled laundry determining step S45 that water-filled laundry is not present. When it is determined in the water-filled laundry determining step S45 that water-filled laundry is present, an error message may be displayed (S46) and then the dehydration drying operation S40 may be terminated, or a water-filled laundry elimination step S44 may be conducted.

The water-filled laundry determining step S45 is conducted at the initial stage of the dehydration drying operation S40 to determine whether water-filled laundry is present in the laundry.

Figure 5:
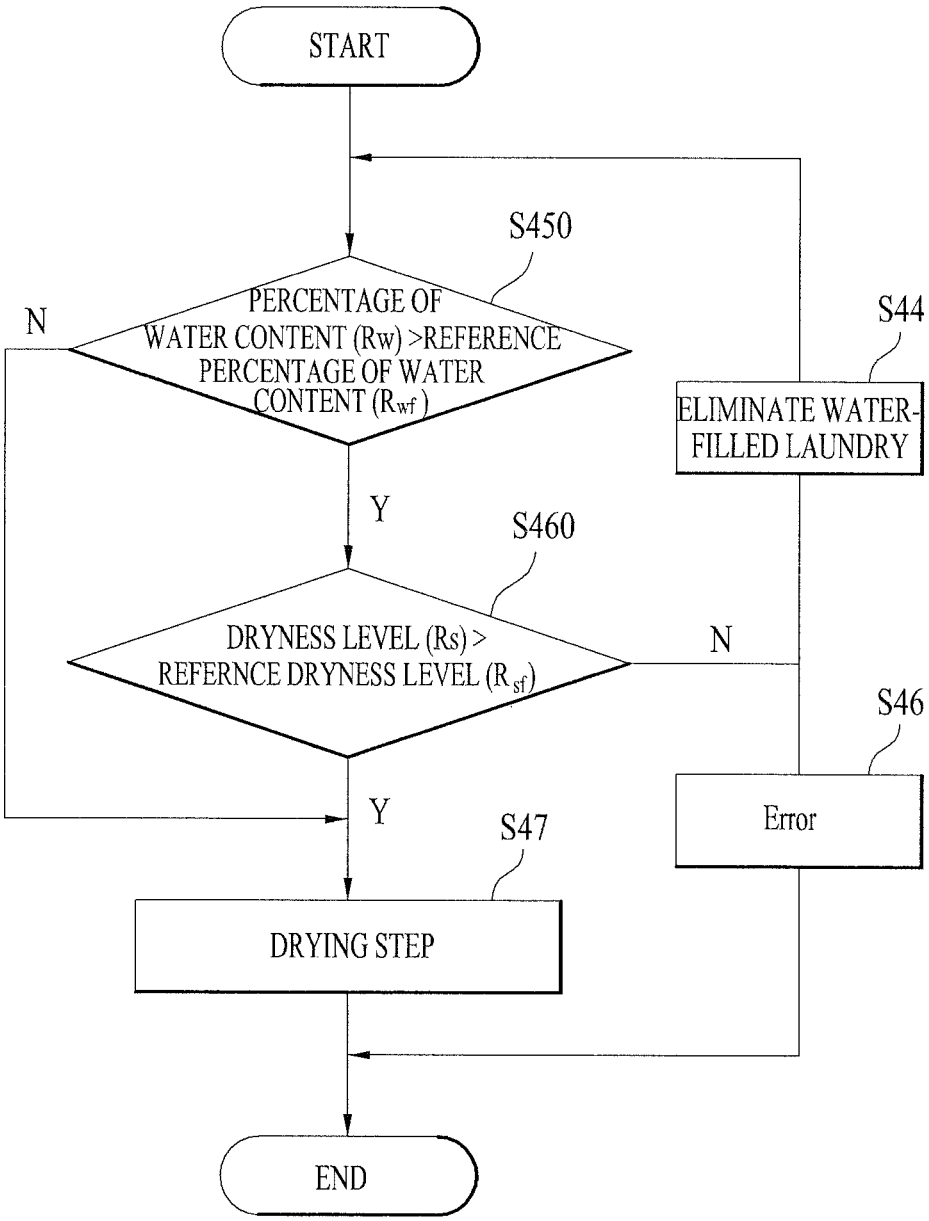
FIG. 5 is a flowchart illustrating an example water-filled laundry determining step in the dehydration drying operation of the example method for controlling a laundry treating apparatus.

Referring to FIG. 5, the water-filled laundry determining step S45 includes a dryness level determining step S460. In the dryness level determining step S460, the dryness level $R_s$ of the laundry is determined. When the dryness level ($R_s$) is higher than the reference dryness level ($R_{sf}$), it is determined that laundry is not water-filled. When the dryness level ($R_s$) is lower than the reference dryness level ($R_{sf}$), it is determined that laundry contains water-filled laundry. When the dryness level ($R_s$) is lower than the reference dryness level ($R_{sf}$), the water-filled laundry elimination step S44 is conducted, or an error message is displayed (S46) and the dehydration drying operation S40 is terminated. When the dryness level R, is higher than the reference dryness level ($R_{sf}$), the dehydration drying step S47 is conducted.

In the dryness level determining step S460, presence of water-filled laundry is determined based on the dryness level ($R_s$) of the laundry. The dryness level ($R_s$) is defined as a ratio of the amount of laundry ($I_0$) in a particular situation to the reference inertia ($I_f$) of the laundry measured with the moisture eliminated by accelerating the drum to a reference RPM ($R_f$).

That is, the dryness level (Rs)=$D_0/I_f$.

In qualitative interpretation, the dryness level Rs is a ratio of the amount of laundry $I_0$ representing the amount of laundry with the water content fixed to a particular reference content to the reference inertia ($I_f$) representing the inertia of the laundry obtained by eliminating the moisture from the laundry by accelerating the drum to the reference RPM ($R_f$). When the drum is accelerated to the reference RPM ($R_f$), the moisture in the laundry in the drum is removed in proportion to the reference RPM. When the reference RPM is high, the amount of removed moisture is large. When the reference RPM is low, the amount of removed moisture is small. In some examples, the drum may be accelerated to the reference RPM to remove a certain amount of moisture from the laundry. When the dryness level (Rs) is higher, it is more likely that the laundry does not contain water-filled laundry. When the dryness level (Rs) is lower, it is more likely that the laundry contains water-filled laundry. That is, a high dryness level (Rs) may be interpreted as indicating that a large amount of moisture has been removed through acceleration of the drum to $R_f$, and a low dryness level (Rs) may interpreted as indicating that a small amount of moisture has been removed through acceleration of the drum to $R_f$. In the case that water-filled laundry is present, but is not eliminated even after the drum has been accelerated to $R_f$, a high reference inertia ($I_f$) is measured due to the weight or inertia of the water-filled laundry, compared to the case of no water-filled laundry. Accordingly, a low dryness level (Rs) is measured.

On the other hand, in the case that no water-filled laundry is present, a low reference inertia ($I_f$) is measured since a certain amount of moisture has been removed through acceleration of the drum to $R_f$, accordingly, a low dryness level is produced.

The amount of laundry ($I_0$) is the amount of laundry measured before the drum is accelerated to $R_f$, representing the amount of laundry measured in a particular environment. It may be sensed through the step of sensing the amount of laundry S10.

The amount of laundry ($I_0$) may be the initial amount of laundry ($D_0$) measured before the washing operation S20 is performed. In this case, the step of sensing the amount of laundry S10 is conducted prior to the washing operation S20. In the case that the initial amount of laundry ($D_0$) is used as the amount of laundry ($I_0$), the particular environment represents the environment in which the laundry is wet in the washing water. Typically, washing is performed upon clothing. Accordingly, the laundry introduced into the drum is usually in a dried state, not in a wet state. As such, the initial amount of laundry ($D_0$) measured in the step of sensing the amount of laundry S10 is the amount of dried laundry. Therefore, as the amount of laundry ($I_0$), the amount of dried laundry, the amount of laundry not wet in the washing water representing the initial amount of laundry ($D_0$), may be used.

Alternatively, the amount of laundry ($I_0$) may be a first amount of dehydrated laundry ($W_1$) measured after termination of the drainage step S33 in the rinsing operation S30. At this time, the step of sensing the amount of laundry S10 may be a first amount of dehydrated laundry sensing step conducted after termination the drainage step S33 of the rinsing operation S30. When the first amount of dehydrated laundry ($W_1$) is used as the amount of laundry ($I_0$), the particular environment represents the environment in which the laundry is sufficiently wet in the washing water. Once the water supply step S31 and the rinsing step S32 are conducted during the rinsing operation S30, the laundry becomes sufficiently wet in the washing water. When the drainage step S33 is conducted in this state to discharge the washing water in the tub 120, the laundry is sufficiently wet. At this time, the laundry is in a supersaturated state in which the laundry cannot absorb the washing water any more. Accordingly, the first amount of dehydrated laundry ($W_1$) measured after termination of the drainage step S33 of the rinsing operation S30 is the amount of supersaturated laundry. As such, as the amount of laundry ($I_0$), the first amount of dehydrated laundry ($W_1$) representing the amount of laundry containing the washing water in a supersaturated state may be used.

In addition, in the dehydration drying operation S40 of the example method for controlling a washing machine, the water-filled laundry determining step S45 may be a percentage of water content determining step S450.

The laundry of high water content having a high percentage of water content (Rw) represents laundry containing water in a relatively large amount. The laundry of high water content may be laundry, such as a towel made of cotton. On the other hand, laundry of low water content represents laundry which contains water in a relatively small amount.

The percentage of water content determining step S450 is a step of determining whether the laundry is laundry of low water content having a low percentage of water content (Rw). When it is determined in the percentage of water content determining step S450 that the laundry is laundry of low water content having a percentage of water content lower than the reference percentage of water content ($R_{wf}$), the dehydration drying step S47 is conducted. When it is determined in the percentage of water content determining step S450 that the laundry is laundry of high water content having a percentage of water content higher than the reference percentage of water content ($R_{wf}$), the dryness level determining step S460 is conducted. However, the disclosure is not limited to this order. The percentage of water content determining step S450 may be conducted before or after the dryness level determining step S460 is conducted.

If the laundry contains water-filled laundry, the measured percentage of water content (Rw) may be high due to water-filled laundry being present in the laundry. If water-filled laundry is not present, the measured percentage of water content (Rw) may be low. Accordingly, whether the laundry contains water-filled laundry may be determined using the percentage of water content (Rw).

The percentage of water content (Rw), used as a reference for determination in the percentage of water content determining step S450, represents a degree to which laundry holds water. A high percentage of water content (Rw) indicates that the laundry has a high capacity of absorption and maintenance of water, while a low percentage of water content (Rw) indicates that the laundry has a low capacity of absorption and maintenance of water.

The percentage of water content (Rw) may be defined as a ratio of the first amount of dehydrated laundry ($W_1$) to the initial amount of laundry ($D_0$).

That is, the percentage of water content (Rw)=$W_1/D_0$. As described above, the initial amount of laundry ($D_0$) represents the amount of dried laundry which does not contain water, and the first amount of dehydrated laundry ($W_1$) represents the amount of laundry in a supersaturated state after termination of the drainage step S33 of the rinsing operation S30. Accordingly, in the case that the first amount of dehydrated laundry ($W_1$) is greater than the amount of dried laundry (i.e., the initial amount of laundry ($D_0$)), the percentage of water content (Rw) is high. In the case that the first amount of dehydrated laundry ($W_1$) is less than the amount of dried laundry, the percentage of water content (Rw) is low. The laundry, such as a towel, has a high percentage of water content (Rw). The underwear made of cotton may also have a high percentage of water content (Rw).

While the percentage of water content (Rw) is illustrated as being defined as a ratio of the first amount of dehydrated laundry ($W_1$) to the initial amount of laundry ($D_0$), any numerical value which allows measurement of the degree to which the laundry holds water may be used. As described below, a second amount of dehydrated laundry ($W_2$) may be measured after the drum is accelerated to the reference RPM ($R_f$). When the percentage of water content (Rw) is high, a large amount of water is removed during acceleration of the drum to the reference RPM. Accordingly, the measured second amount of dehydrated laundry ($W_2$) may be lower than the first amount of dehydrated laundry ($W_1$). In the case that the percentage of water content (Rw) is low, the measured second amount of dehydrated laundry ($W_2$) is larger than in the laundry having a high percentage of water content (Rw). As such, the percentage of water content (Rw) may be defined as a ratio of the first amount of dehydrated laundry ($W_1$) to the second amount of dehydrated laundry ($W_2$) or a ratio of a difference between the first amount of dehydrated laundry ($W_1$) and the second amount of dehydrated laundry ($W_2$) to the first amount of dehydrated laundry ($W_1$). That is, the percentage of water content (Rw)=(the first amount of dehydrated laundry ($W_1$)−the second amount of dehydrated laundry ($W_2$))/the first amount of dehydrated laundry ($W_1$).

That is, the percentage of water content (Rw) may be defined as $R_w=W_1/W_2$ or $(W_1-W_2)/W_1$.

Any numerical values which allow measurement of the capacity to hold water may be defined as the percentage of water content (Rw).

As described above, the water-filled laundry determining step S45 may include the dryness level determining step S460 or the percentage of water content determining step S450. For instance, the water-filled laundry determining step S45 includes both the dryness level determining step S460 and the percentage of water content determining step S450.

In the dryness level determining step S460, when the dryness level (Rs) is lower than the reference dryness level ($R_{sf}$), it may be determined that the laundry contains water-filled laundry. When the dryness level ($R_s$) is higher than the reference dryness level ($R_{sf}$), it may be determined that the laundry does not contain water-filled laundry.

In the percentage of water content determining step S450, when the percentage of water content (Rw) is lower than the reference percentage of water content ($Rw_f$), it may be determined that the laundry does not contain water-filled laundry. When the percentage of water content (Rw) is higher than the reference percentage of water content ($Rw_f$), it may be determined that the laundry contains water-filled laundry.

In the case that the water-filled laundry determining step S45 includes both the dryness level determining step S460 and the percentage of water content determining step S450, when the dryness level ($R_s$) of the laundry is lower than the reference dryness level ($R_{sf}$) and the percentage of water content (Rw) is higher than the reference percentage of water content ($Rw_f$), it may be determined that the laundry contains water-filled laundry. In this case, the water-filled laundry elimination step S44 may be conducted, or an error message may be displayed (S46) and then the dehydration drying operation S40 may be terminated.

When the dryness level ($R_s$) of the laundry is higher than the reference dryness level ($R_{sf}$) and the percentage of water content (Rw) is higher than the reference percentage of water content ($Rw_f$), it may be determined that the laundry is high water content laundry, such as a towel. Then, the dehydration drying step S47 is conducted.

When the dryness level ($R_s$) of the laundry is higher than the reference dryness level ($R_{sf}$) and the percentage of water content (Rw) is lower than the reference percentage of water content ($Rw_f$), it may be determined that the laundry is typical laundry. Then, the dehydration drying step S47 is conducted.

When the dryness level ($R_s$) of the laundry is lower than the reference dryness level ($R_{sf}$) and the percentage of water content (Rw) is lower than the reference percentage of water content ($Rw_f$), it may be determined that the laundry is the laundry of low water content, such as outdoor clothing having a waterproof function. Then, the dehydration drying step S47 is conducted.

The water-filled laundry determining step S45 may include both the percentage of water content determining step S450 and the dryness level determining step S460. However, the disclosure is not limited thereto.

For example, in the case that a towel washing course of washing towels is separately provided, when the user introduces only towels into the drum and selects the towel washing course, the water-filled laundry determining step S45 may consist of the percentage of water content determining step S450. In addition, in the case that the waterproof laundry washing course of washing the laundry of low water content, such as outdoor clothing, is separately provided, the water-filled laundry determining step S45 may consist of the dryness level determining step S460.

Figure 6:
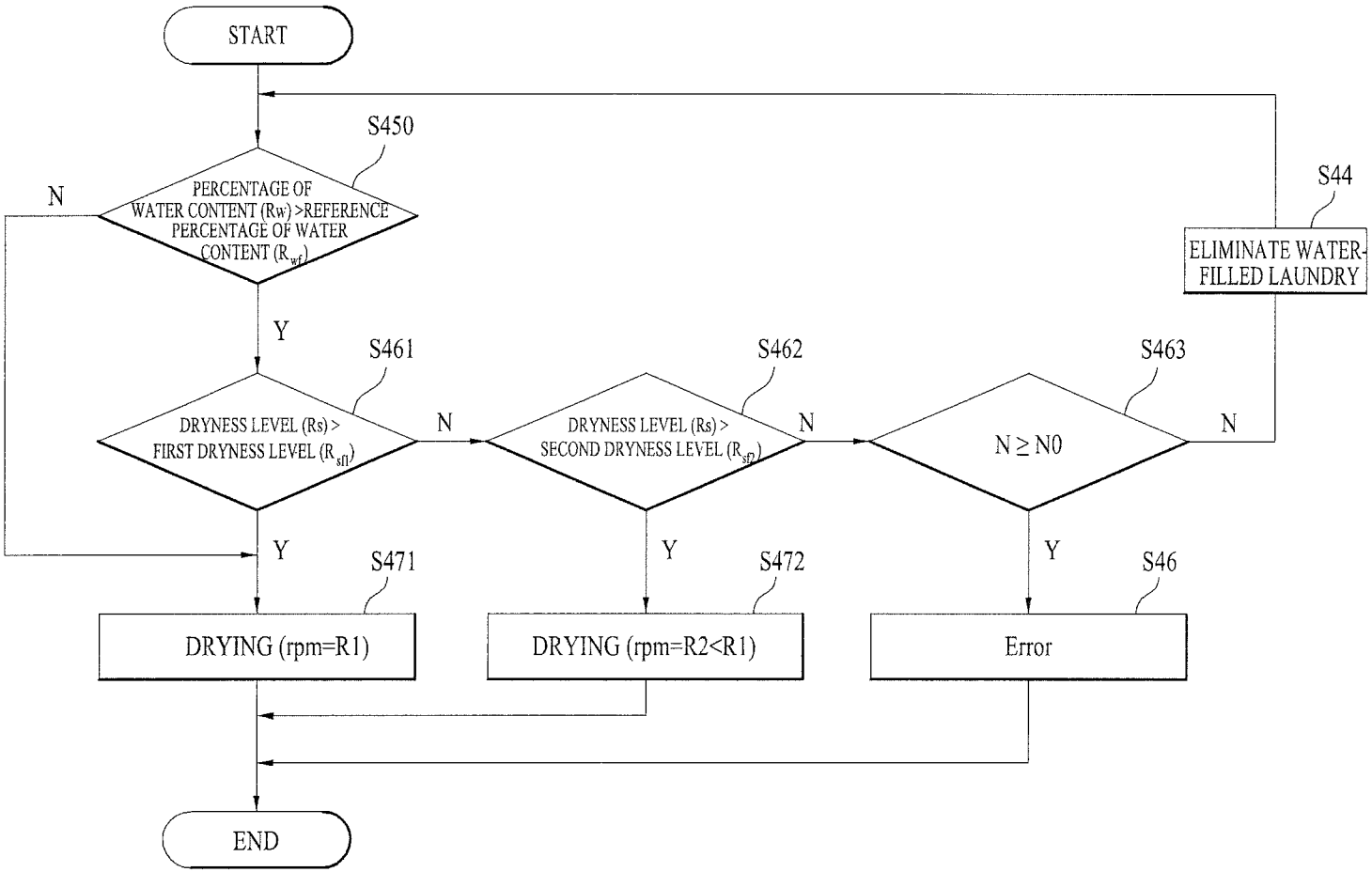
FIG. 6 is a flowchart illustrating an example dryness level determination in the example dehydration drying operation of the example method for controlling a laundry treating apparatus.

Referring to FIG. 6, in the dryness level determining step S460, the rate of rotation of the drum for dehydration drying may change depending on the range of the dryness level (Rs).

In some implementations, in the dryness level determining step S460, the range of the dryness level (Rs) is divided into at least two sections, and the dehydration drying operation is performed at a different rates of rotation of the drum in each section.

In some examples, the range of the dryness level (Rs) may be divided into three sections. That is, the range of the dryness level (Rs) may be divided into a first section higher than a first dryness level ($R_{sf1}$), a second section higher than a second dryness level ($R_{sf2}$) and equal to or lower than the first dryness level ($R_{sf1}$), and a third section lower than the second dryness level ($R_{sf2}$). In these examples, the dryness level determining step S460 may include a first dryness level determining step S461 that uses the first dryness level ($R_{sf1}$) and a second dryness level determining step S462 that uses the second dryness level ($R_{sf2}$).

When the dryness level (Rs) is within the first section, it is determined that the laundry does not contain water-filled laundry, and thus the drum is rotated at the normal RPM, R1 to conduct the dehydration drying step S471. For example, the rate of rotation R1 of the drum may be equal to or higher than 800 RPM and the maximum value thereof may be 1010 RPM.

When the dryness level (Rs) is within the second section, it is determined that the laundry has a relatively small likelihood of containing water-filled laundry, or the size or the amount of water-filled laundry is relatively small, and thus the drum is rotated at an RPM, R2 lower than the normal RPM, R1 to conduct the dehydration drying step S472. For example, the rate of rotation R2 of the drum may be equal to or higher than 430 RPM, and the maximum value thereof may be 500 RPM.

When the dryness level (Rs) is within the third section, it is determined that the laundry is highly likely to contain water-filled laundry, and/or the size or the amount of water-filled laundry is large.

In the case that the dryness level (Rs) falls within the third section, the number of times (N) of determining that the dryness level (Rs) falls in the third section is counted (S463). When the number of times (N) is equal to or greater than the reference number (N0), an error message is displayed (S46), and then the dehydration drying operation S40 is terminated. When the number of times (N) is less than the reference number N0, the water-filled laundry elimination step S44 is conducted and then the dryness level determining step S460 is conducted. In the case that the number of times (N) is equal to or greater than the reference number (N0), the water-filled laundry elimination step S44 has been conducted at least once, and thus the dryness level (Rs) is performed again in the third section despite conduction of the water-filled laundry elimination step S44. Accordingly, an error message is displayed (S46), and then the dehydration drying operation S40 is terminated. The reference number N0 may be 2.

The water-filled laundry elimination step S44 may include a laundry untangling step. The laundry untangling step is a step of repeating at least one of forward rotation and reverse rotation of the drum 130 at least once to untangle the tangled laundry in the drum 130. In the laundry untangling step, the forward rotation or reverse rotation of the drum 130 may be repeated for a certain time. Alternatively, the forward rotation and reverse rotation of the drum may be repeated. When the forward and reverse rotations of the drum 130 are repeated in the laundry untangling step, water-filled laundry may be eliminated. The water-filled laundry elimination step S44 may include a water supply step of supply washing water to the tub 120, which is conducted prior to the laundry untangling step. In the case that the water supply step is conducted prior to the laundry untangling step, the washing water in the tub 120 may be drained through the drainage step after the laundry untangling step is conducted.

Hereinafter, an example of the water-filled laundry determining step S45 is described with reference to FIG. 9 in conjunction with FIGS. 7 and 8.

An example method for measurement of the dryness level (Rs) and the percentage of water content (Rw) in the water-filled laundry determining step S45 of a laundry treating apparatus will be described first and then an example method for controlling the laundry treating apparatus will be described.

In this example, the values for calculation of the percentage of water content (Rw) and the dryness level (Rs) are calculated based on the current consumed to rotate the drum.

The amount of laundry ($I_0$) and the reference inertia ($I_f$) which are values defining the dryness level (Rs) are both proportional to the weight of the laundry, and the weight of the laundry is proportional to the inertia of the laundry. Accordingly, as the weight or inertia of the laundry increases, torque needed to rotate the drum containing the laundry at certain acceleration also increases. The torque is proportional to the current applied to the drive motor. Accordingly, the amount of laundry ($I_0$) or the reference inertia ($I_f$) is proportional to the total current consumed to rotate the drum with a certain acceleration for a certain time. Therefore, by measuring the current, the amount of laundry ($I_0$) and the reference inertia ($I_f$) may be measured and the dryness level (Rs) may be calculated.

The first amount of dehydrated laundry ($W_1$) needed to calculate the percentage of water content (Rw) is also proportional to the weight of the laundry, which is in turn proportional to the inertia of the laundry. Accordingly, the first amount of dehydrated laundry ($W_1$) is proportional to the total current consumed to rotate the drum at certain acceleration for a certain time. The other details are the same as above, and a description thereof will be referenced, rather than repeated.

First, calculation of the dryness level (Rs) will be described.

As described above, the dryness level (Rs) may be defined as a ratio of the amount of laundry ($I_0$) in a particular situation to the reference inertia ($I_f$) of the laundry measured with the moisture removed by accelerating the drum to a reference RPM ($R_f$). The amount of laundry ($I_0$) and the reference inertia ($I_f$) depend upon the total current consumed to rotate the drum at certain acceleration for a certain time.

As previously described, the amount of laundry ($I_0$) represents the amount of laundry measured in a particular environment. The particular environment may represent the environment in which the laundry is not wet in the washing water or the environment in which the laundry is in a supersaturated state. Accordingly, the amount of laundry ($I_0$) may be the initial amount of laundry ($D_0$) measured prior to the washing operation S20, or the first amount of dehydrated laundry (W1) measured in the rinsing operation S30 after termination of the drainage step S33.

In the case that the amount of laundry ($I_0$) is the initial amount of laundry ($D_0$), the amount of laundry ($I_0$) may be the initial-amount-of-laundry current ($A_0$). In the case that the amount of laundry ($I_0$) is the first amount of dehydrated laundry ($W_1$), the amount of laundry ($I_0$) may be a first-amount-of-dehydrated-laundry current ($A_1$). In addition, the reference inertia ($I_f$) may be a reference current ($A_f$), which will be described below.

First, measurement of the initial-amount-of-laundry current ($A_0$) and the reference current ($A_f$) will be described.

In the case that the amount of laundry ($I_0$) is the initial amount of laundry ($D_0$), the dryness level (Rs) may be defined with the initial-amount-of-laundry current ($A_0$) and the reference current ($A_f$). That is, the dryness level (Rs)=the initial-amount-of-laundry current ($A_0$)/the reference current ($A_f$) ($Rs=A_0/A_f$).

The amount of laundry ($I_0$) defining the dryness level (Rs) may be the initial amount of laundry ($D_0$) measured in the step of sensing the amount of laundry S10 conducted prior to the washing operation S20. According to this implementation, in the step of sensing the amount of laundry S10, the initial amount of laundry ($D_0$) may be measured with the initial-amount-of-laundry current ($A_0$), the total current consumed to maintain the drum at a speed for sensing of the initial amount of laundry for a certain time. The initial-amount-of-laundry current ($A_0$) is proportional to the initial amount of laundry ($D_0$) introduced into the drum. The initial amount of laundry ($D_0$) may be defined using a correlation table between the initial-amount-of-laundry current ($A_0$) and the initial amount of laundry ($D_0$) actually introduced into the drum, which is obtained through experimentation. Alternatively, the initial amount of laundry ($D_0$) may be defined as the initial-amount-of-laundry current ($A_0$).

The certain time may be 30 seconds, and the speed for sensing of the initial amount of laundry may be 30 rpm. In this case, the initial-amount-of-laundry current ($A_0$) is the total current consumed to maintain the drum containing dry laundry at 30 rpm for 30 seconds.

Next, a reference inertia measuring step S42 of measuring the reference inertia ($I_f$) among other variables defining the dryness level (Rs) will be described.

The reference inertia measuring step S42 includes a first acceleration step S421 of accelerating the drum containing the laundry upon which the rinsing operation S30 has been completed to a first RPM. The reference inertia measuring step S42 further includes a deceleration step S422 of decelerating the drum to a second RPM lower than the first RPM. The reference inertia measuring step S42 further includes a reference current measuring step S423 of measuring a reference current ($A_f$), the total current consumed to accelerate the drum from the second RPM at a reference acceleration for a reference time ($\Delta t_f$). In this example, the reference inertia ($I_f$) may be defined based on the reference current ($A_f$). Accordingly, the reference inertia may be defined as a value obtained by normalizing the reference current ($A_f$) or a value dependent upon the reference current ($A_f$). Also, In this example, the reference inertia ($I_f$) is defined as the reference current ($A_f$).

Figure 7:
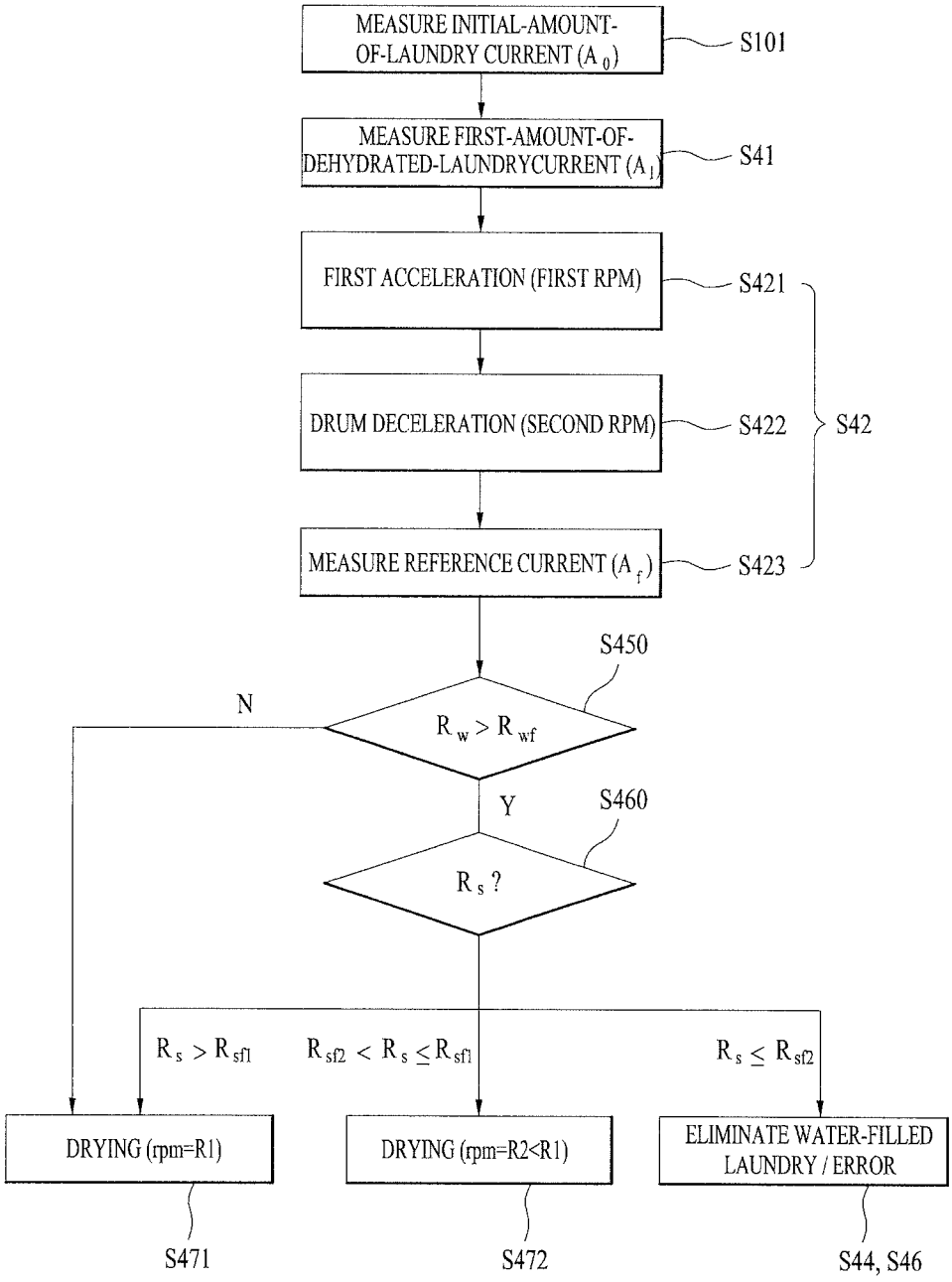
FIGS. 7 and 8 are flowcharts illustrating an example method for controlling a laundry treating apparatus.
Figure 9:
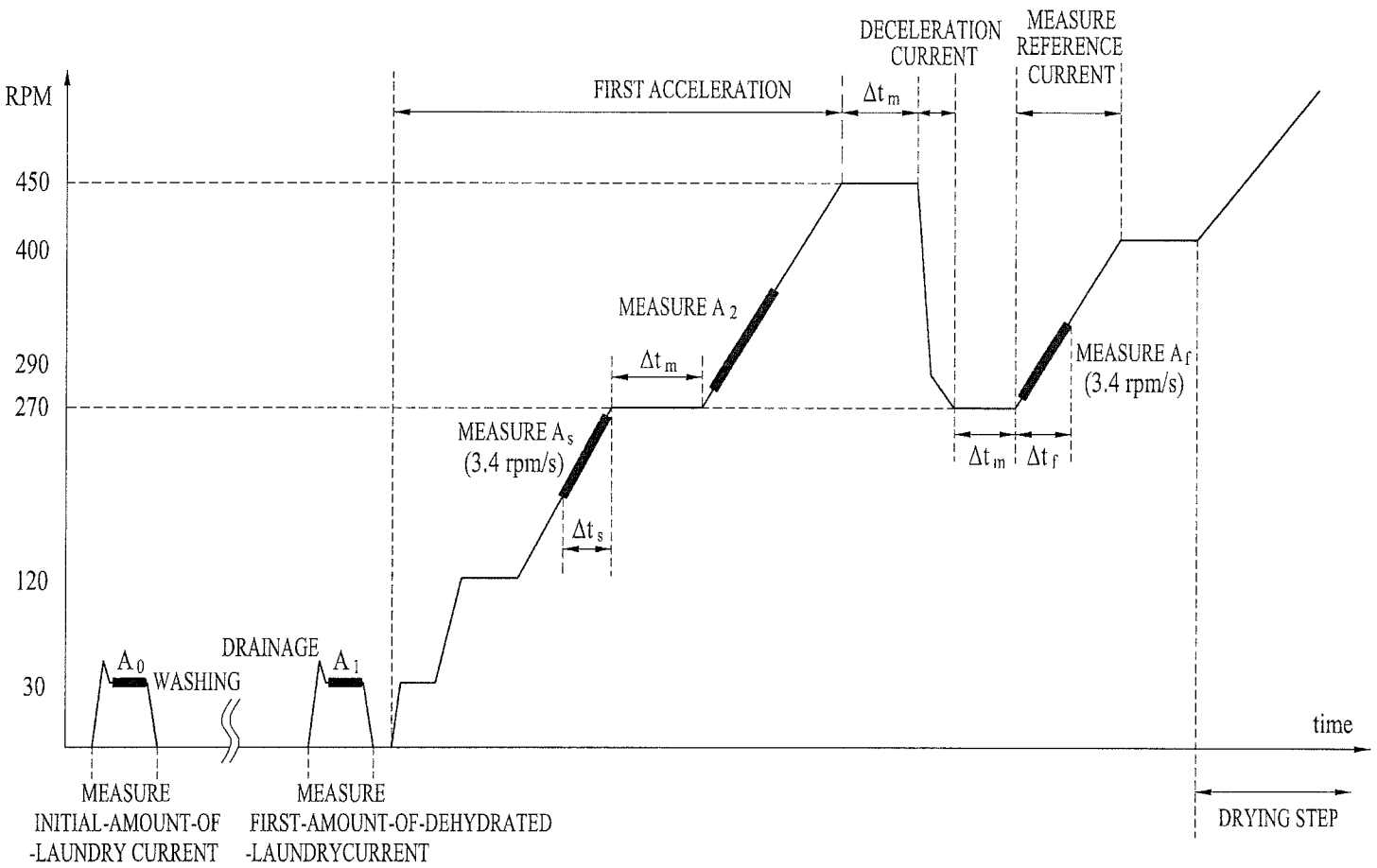
FIG. 9 is a view illustrating example change of the rate of rotation of the drum in an example method for controlling a laundry treating apparatus.

Referring to FIGS. 7 and 9, after the rinsing operation S30 is completed, the first acceleration step S421 follows, in which the drum is accelerated to the first RPM. The first RPM may be about 450 RPM. The deceleration step S422 may follow immediately after completion of the first acceleration step S421. In some implementations, the rate of rotation of the drum is maintained at the first RPM for a predetermined time ($\Delta t_m$), and then the deceleration step S422 follows. The predetermined time ($\Delta t_m$) may be 5 seconds or 10 seconds.

In the deceleration step S422, the rate of rotation of the drum is decreased from the first RPM to the second RPM. At this time, the drum 130 may be decelerated by interrupting power to the drive motor 140 which rotates the drum 130 or by applying a reverse voltage to the drive motor 140. The second RPM may be about 270 RPM. The reference current measuring step S423 may immediately follow after the deceleration step S422 is conducted. For instance, the rate of rotation of the drum is maintained at the second RPM for a predetermined time ($\Delta t_m$), and then the reference current measuring step S423 follows. The predetermined time ($\Delta t_m$) may be 5 seconds or 10 seconds.

In the reference current measuring step S423, a reference current ($A_f$), the total current consumed to accelerate the drum decelerated to the second RPM at a reference acceleration for a reference time ($\Delta t_f$), is measured. Herein, the reference acceleration may be 3.4 rpm/s, and the reference time ($\Delta t_f$) may be 38 seconds. In this case, therefore, the total current consumed to accelerate the drum having been decelerated to 270 rpm through the deceleration step S422 at the acceleration of 3.4 rpm/s for 38 seconds is the reference current ($A_f$).

In this example, when the amount of laundry ($I_0$) is the first amount of dehydrated laundry ($W_1$), the amount of laundry ($I_0$) may be the first-amount-of-dehydrated-laundry current ($A_1$).

When the amount of laundry ($I_0$) is the first amount of dehydrated laundry ($W_1$), the dryness level (Rs) may be defined using the first-amount-of-dehydrated-laundry current ($A_1$) and the reference current ($A_f$). That is, the dryness level (Rs)=the first-amount-of-dehydrated-laundry current ($A_1$)/the reference current ($A_f$). That is, $Rs=A_1/A_f$.

The reference current ($A_f$) may be determined using the techniques described above, and thus a description thereof will be referenced, rather than repeated. Hereinafter, measurement of the first-amount-of-dehydrated-laundry current ($A_1$) will be described.

In some implementations, the amount of laundry ($I_0$) defining the dryness level (Rs) may be the first amount of dehydrated laundry ($W_1$) measured in the first amount of dehydrated laundry sensing step S41. The first amount of dehydrated laundry sensing step is conducted after termination of the drainage step S33 of the rinsing operation S30. Accordingly, the laundry is in the supersaturated state before the first amount of dehydrated laundry sensing step is conducted.

According to these implementations, in the first amount of dehydrated laundry sensing step S41, the first amount of dehydrated laundry ($W_1$) may be measured with the first-amount-of-dehydrated-laundry current ($A_1$), the total current consumed to maintain the drum at a speed for sensing of the first amount of dehydrated laundry for a certain time. The first-amount-of-dehydrated-laundry current ($A_1$) is proportional to the first amount of dehydrated laundry ($W_1$) accommodated in the drum. The first amount of dehydrated laundry ($W_1$) may be defined with a table of correlation between the first-amount-of-dehydrated-laundry current ($A_1$) and the first amount of dehydrated laundry ($W_1$) actually introduced into the drum, which is obtained through experimentation. Alternatively, the first amount of dehydrated laundry ($W_1$) may be defined as the first-amount-of-dehydrated-laundry current ($A_1$).

The certain time may be 30 seconds, and the speed for sensing of the first amount of dehydrated laundry may be 30 rpm. In this case, the first-amount-of-dehydrated-laundry current ($A_1$) is the total current consumed to maintain the drum containing dry laundry at 30 rpm for 30 seconds.

Figure 8:
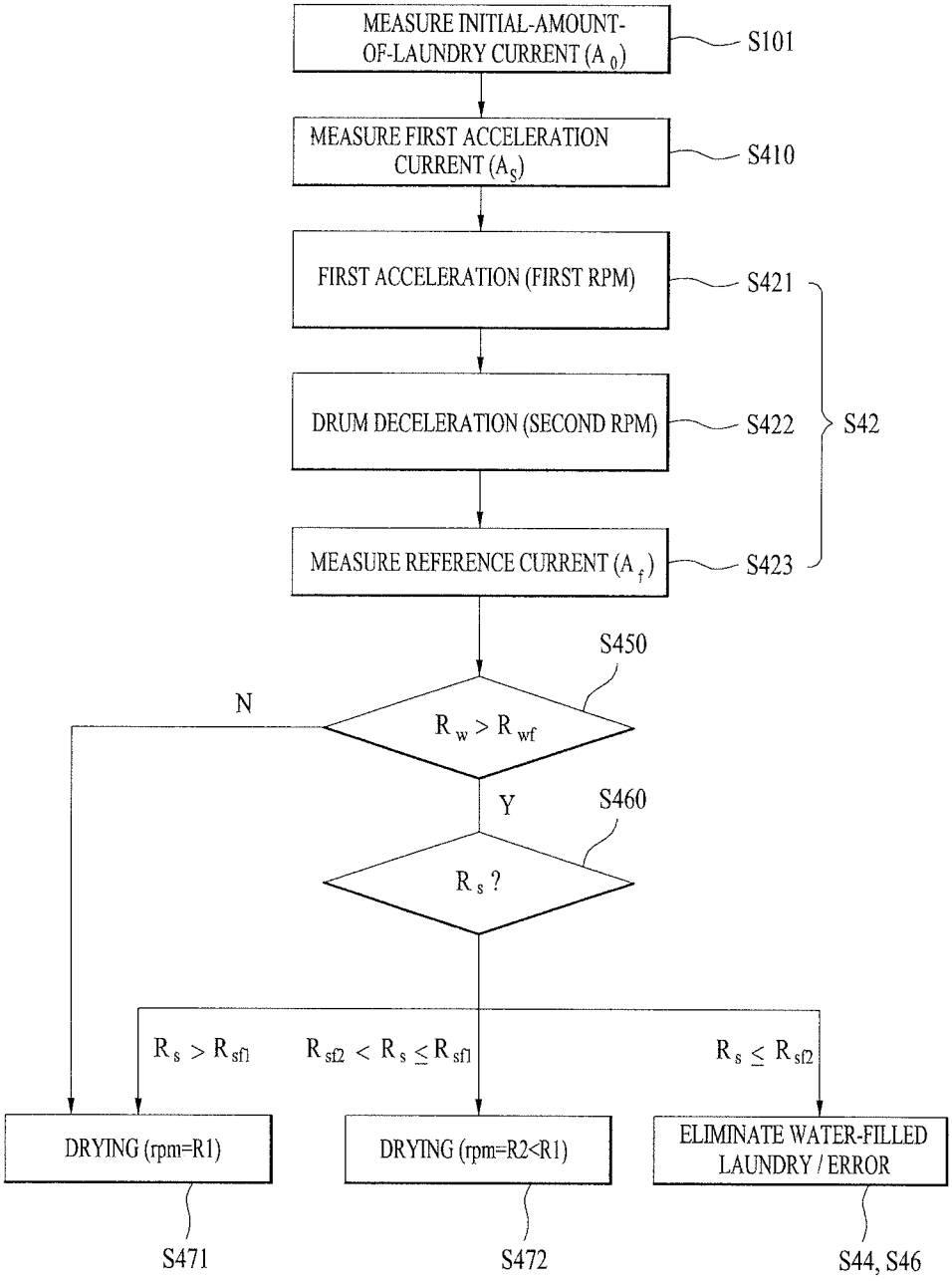

Referring to FIG. 8, the first-amount-of-dehydrated-laundry current ($A_1$) may be replaced by a first acceleration current (As), the total current consumed to accelerate the drum containing supersaturated laundry at a first acceleration for a certain time ($\Delta t_s$). The first acceleration current (As) is proportional to the first-amount-of-dehydrated-laundry current ($A_1$). That is, the first-amount-of-dehydrated-laundry current ($A_1$) consumed to maintain the drum containing the laundry in the supersaturated state at a certain speed for a certain time after termination of the drainage step S33 of the rinsing operation S30 is proportional to the first acceleration current (As) consumed to accelerate the drum containing the laundry at the first acceleration for a first time ($\Delta t_s$). Accordingly, the first acceleration current (As) may be used in place of the first-amount-of-dehydrated-laundry current ($A_1$). The first time ($\Delta t_s$) may be 45 seconds, and the first acceleration may be 3.4 revolutions per second. In addition, the first acceleration current (As) may be measured before the second RPM is reached. That is, the first acceleration current (As) may be measured with the least amount of moisture removed from the supersaturated laundry. Accordingly, the first acceleration current (As) is measured at the initial stage of the dehydration drying operation S40. In some examples, the first acceleration current (As) is measured before the drum reaches 270 rpm.

In this case, the dryness level (Rs) may be defined as a ratio of the first acceleration current (As) to the reference current ($A_f$). That is, the dryness level (Rs)=the first acceleration current (As)/the reference current ($A_f$).

That is, $Rs=As/A_f$.

Hereinafter, calculation of a percentage of water content (Rw) will be described.

As described above, the percentage of water content (Rw) indicates the degree to which the laundry maintains moisture therein.

The percentage of water content (Rw) may be defined as a ratio between the initial amount of laundry ($D_0$) and the first amount of dehydrated laundry ($W_1$). That is, the percentage of water content (Rw)=the first amount of dehydrated laundry ($W_1$)/the initial amount of laundry ($D_0$) ($Rw=W_1/D_0$).

In some examples, the current consumed to rotate the drum with a certain acceleration for a certain time is used to calculate the percentage of water content (Rw).

Accordingly, in these examples, the percentage of water content (Rw) may be defined as a ratio between the initial-amount-of-laundry current ($A_0$) measured in the step of sensing the amount of laundry S10, which is conducted prior to the washing operation S20 and the first-amount-of-dehydrated-laundry current ($A_1$) measured in the first amount of dehydrated laundry sensing step.

Accordingly, the percentage of water content (Rw) may be defined as the percentage of water content (Rw)=the first-amount-of-dehydrated-laundry current ($A_1$)/the initial-amount-of-laundry current ($A_0$).

That is, $Rw=A_1/A_0$.

The first-amount-of-dehydrated-laundry current ($A_1$) and the initial-amount-of-laundry current ($A_0$) are measured in the same manner as measurement of the first-amount-of-dehydrated-laundry current ($A_1$) and the initial-amount-of-laundry current ($A_0$) in calculating of the dryness level (Rs), and thus a description thereof will be referenced, rather than repeated.

Also, as described above, the first-amount-of-dehydrated-laundry current ($A_1$) may be replaced by the first acceleration current (As), the total current consumed to accelerate the drum containing supersaturated laundry at the first acceleration for a certain time.

Accordingly, the percentage of water content (Rw)=the first acceleration current (As)/the initial-amount-of-laundry current ($A_0$).

That is, $Rw=As/A_0$.

Hereinafter, an example method for controlling a laundry treating apparatus will be described with reference to FIGS. 7 and 9.

The method for controlling a laundry treating apparatus may include an initial-amount-of-laundry current measuring step S101. The method may further include a first-amount-of-dehydrated-laundry current measuring step S41. The method may further include the reference inertia measuring step S42 of measuring the reference inertia ($I_f$). The method may further include the water-filled laundry determining step S450, S460 of determining whether the laundry contains water-filled laundry using at least one of the percentage of water content (Rw) and the dryness level (Rs). The method may further include the dehydration drying step S471, S472 of performing dehydration drying according to the water-filled laundry determining step S450, S460.

The initial-amount-of-laundry current measuring step S101 is conducted prior to the washing operation S20 to sense the amount of laundry in the drum. In the initial-amount-of-laundry current ($A_0$) measuring step S101, the initial-amount-of-laundry current ($A_0$) may be measured by maintaining the drum at a speed for sensing of the initial amount of laundry for a certain time and measuring the total current consumed to maintain the speed. The certain time may be 30 seconds, and the speed for sensing of the initial amount of laundry may be 30 rpm. In this case, the initial-amount-of-laundry current ($A_0$) is the total current consumed to maintain the drum containing dry laundry at 30 rpm for 30 seconds. When the initial-amount-of-laundry current measuring step S101 is completed, the washing operation S20 and the rinsing operation S30 are conducted.

The first-amount-of-dehydrated-laundry current measuring step S41 is a step of measuring the amount of laundry in the drum after the drainage step S33 of the rinsing operation S30 is terminated. The laundry is in the supersaturated state before the first-amount-of-dehydrated-laundry current measuring step S41 is conducted.

In the first-amount-of-dehydrated-laundry current measuring step S41, the first-amount-of-dehydrated-laundry current ($A_1$) may be measured by maintaining the drum at a speed for sensing of the first amount of dehydrated laundry for a certain time and measuring the total current consumed to maintain the speed. The certain time may be 30 seconds, and the speed for sensing of the initial amount of laundry may be 30 rpm. In this case, the first-amount-of-dehydrated-laundry current ($A_1$) is the total current consumed to maintain the drum containing dry laundry at 30 rpm for 30 seconds.

The reference inertia measuring step S42 is a step of measuring the reference inertia ($I_f$) necessary for calculation of the dryness level (Rs).

The reference inertia measuring step S42 includes a first acceleration step S421 of accelerating the drum containing the laundry upon which the rinsing operation S30 has been completed to a first RPM. The reference inertia measuring step S42 further includes a deceleration step S422 of decelerating the drum to a second RPM lower than the first RPM. The reference inertia measuring step S42 further includes a reference current measuring step S423 of measuring a reference current ($A_f$), the total current consumed to accelerate the drum from the second RPM at a reference acceleration for a reference time ($\Delta t_f$). In this example, the reference inertia ($I_f$) is defined as the reference current ($A_f$).

In the first acceleration step S421, the drum is accelerated to the first RPM. In addition, in the first acceleration step S421, the drum may be continuously accelerated to the first RPM or may be accelerated in a stepwise manner as shown in FIG. 9. The first RPM may be about 450 RPM. The deceleration step S422 may follow immediately after completion of the first acceleration step S421. In some examples, the rate of rotation of the drum is maintained at the first RPM for a predetermined time ($\Delta tm$), and then the deceleration step S422 follows. The predetermined time ($\Delta t_m$) may be 5 seconds or 10 seconds.

In the deceleration step S422, the rate of rotation of the drum is decreased from the first RPM to the second RPM. At this time, the drum 130 may be decelerated by interrupting power to the drive motor 140 which rotates the drum 130 or by applying a reverse voltage to the drive motor 140. The second RPM is lower than the first RPM. The second RPM may be about 270 RPM. The reference current measuring step S423 may follow immediately after the deceleration step S422 is conducted. In some implementations, the rate of rotation of the drum is maintained at the second RPM for a predetermined time ($\Delta t_m$), and then the reference current measuring step S423 follows. The predetermined time ($\Delta t_m$) may be 5 seconds or 10 seconds.

In the reference current measuring step S423, a reference current ($A_f$), the total current consumed to accelerate the drum decelerated to the second RPM at a reference acceleration for a reference time ($\Delta t_f$), is measured. Herein, the reference acceleration may be 3.4 rpm/s, and the reference time ($\Delta t_f$) may be 38 seconds. In this case, therefore, the total current consumed to accelerate the drum having been decelerated to 270 rpm through the deceleration step S422 at the acceleration of 3.4 rpm/s for 38 seconds is the reference current ($A_f$).

In the water-filled laundry determining step S450, S460, whether the laundry contains water-filled laundry is determined using at least one of the dryness level (Rs) and the percentage of water content (Rw).

The water-filled laundry determining step may include the dryness level determining step S460 or the percentage of water content determining step S450. In some implementations, the water-filled laundry determining step includes both the dryness level determining step S460 and the percentage of water content determining step S450. The percentage of water content determining step S450 and the dryness level determining step S460 may be conducted in any order. For example, the percentage of water content determining step S450 may be conducted prior to the dryness level determining step S460.

According to this example, the dryness level (Rs) may be the first-amount-of-dehydrated-laundry current ($A_1$)/the reference current ($A_f$). In addition, the percentage of water content (Rw) may be the first-amount-of-dehydrated-laundry current ($A_1$)/the initial-amount-of-laundry current ($A_0$). That is, $Rs=A_1/A_f$, $Rw=A_1/A_0$.

In the percentage of water content determining step S450, when the water content (Rw) is lower than the reference percentage of water content ($Rw_f$), it may be determined that the laundry does not contain water-filled laundry. When the water content (Rw) is higher than the reference percentage of water content ($Rw_f$), it may be determined that the laundry contains water-filled laundry. In the percentage of water content determining step S450, the dehydration drying step S471 is conducted when the percentage of water content (Rw) is lower than the reference percentage of water content ($R_{wf}$), while the dryness level determining step S460 is conducted when the percentage of water content (Rw) is higher than the reference percentage of water content ($R_{wf}$).

In the dryness level determining step S460, when the dryness level (Rs) is lower than the reference dryness level ($R_{sf}$), it may be determined that the laundry contains water-filled laundry. When the dryness level ($R_s$) is higher than the reference dryness level ($R_{sf}$), it may be determined that the laundry does not contain water-filled laundry. When the dryness level (Rs) is lower than the reference dryness level ($R_{sf}$), an error message may be displayed (S46) and the dehydration drying operation S40 may be terminated, or the water-filled laundry elimination step S44 may be conducted. When the dryness level (Rs) is higher than the reference dryness level ($R_{sf}$), the dehydration drying steps S471 and S472 are conducted and the dehydration drying operation S40 is terminated.

In the dryness level determining step S460, the range of the dryness level (Rs) may be divided into at least two sections, and the dehydration drying operation may be performed at a different rate of rotation of the drum in each section.

In some examples, the range of the dryness level (Rs) may be divided into three sections. That is, the range of the dryness level (Rs) may be divided into a first section higher than a first dryness level ($R_{sf1}$), a second section higher than a second dryness level ($R_{sf2}$) and equal to or lower than the first dryness level ($R_{sf1}$), and a third section lower than the second dryness level ($R_{sf2}$).

When the dryness level (Rs) is within the first section, it is determined that the laundry does not contain water-filled laundry, and thus the drum is rotated at the normal RPM, R1 to conduct the dehydration drying step S471. For example, the rate of rotation R1 of the drum may be equal to or higher than 800 RPM and the maximum value thereof may be 1010 RPM.

When the dryness level (Rs) is within the second section, it is determined that the laundry potentially contains water-filled laundry, or the size or the amount of the water-filled laundry is small, and thus the drum is rotated at an RPM, R2 lower than the normal RPM, R1 to conduct the dehydration drying step S472. For example, the rate of rotation R2 of the drum may be equal to or higher than 430 RPM, and the maximum value thereof may be 500 RPM.

When the dryness level (Rs) is within the third section, it is determined that the laundry is likely to contain water-filled laundry and that the size or the amount of the water-filled laundry is large.

In the case that the dryness level (Rs) falls within the third section, the number of times (N) of determining that the dryness level (Rs) falls within the third section is counted (S463). When the number of times (N) is equal to or greater than the reference number (N0), an error message is displayed (S46), and then the dehydration drying operation S40 is terminated (see FIG. 6). When the number of times (N) is less than the reference number N0, the water-filled laundry elimination step S44 is conducted and then the dryness level determining step S460 is conducted. In the case that the number of times (N) is equal to or greater than the reference number (N0), the water-filled laundry elimination step S44 has been conducted at least once, and thus the dryness level (Rs) falls again within the third section despite conduction of the water-filled laundry elimination step S44. Accordingly, an error message is displayed (S46), and then the dehydration drying operation S40 is terminated. The reference number N0 may be 2 (see FIG. 6).

The water-filled laundry elimination step S44 may include a laundry untangling step. The laundry untangling step is a step of repeating at least one of forward rotation and reverse rotation of the drum 130 at least once to untangle the tangled laundry in the drum 130. When the forward and reverse rotations of the drum 130 are repeated in the laundry untangling step, water-filled laundry may be lessened. The water-filled laundry elimination step S44 may include a water supply step of supply washing water to the tub 120, which is conducted prior to the laundry untangling step. In the case that the water supply step is conducted prior to the laundry untangling step, the washing water in the tub 120 may be drained through the drainage step after the laundry untangling step is conducted.

As described above, the first-amount-of-dehydrated-laundry current ($A_1$) may be replaced by the first acceleration current (As). In this case, the dryness level (Rs) may be the first acceleration current (As)/the reference current. In addition, the percentage of water content (Rw) may be the first acceleration current (As)/the initial-amount-of-laundry current ($A_0$).

Referring to FIGS. 8 and 9, in the case that the first-amount-of-dehydrated-laundry current ($A_1$) is replaced by the first acceleration current (As), the first-amount-of-dehydrated-laundry current measuring step S41 may be replaced by a first acceleration current measuring step S410. However, the disclosure is not limited thereto. Both the first-amount-of-dehydrated-laundry current measuring step S41 and the first acceleration current measuring step S410 may be conducted.

In the first acceleration current measuring step S410, the total current consumed to accelerate the drum containing supersaturated laundry with the first acceleration for the first time ($\Delta t_s$) is measured. That is, after the drainage step S33 of the rinsing operation S30 is terminated, the first acceleration current measuring step S410 may be conducted. The first time ($\Delta t_s$) may be 45 seconds, and the first acceleration may be 3.4 rpm/s.

The first acceleration current measuring step S410 may be conducted in the first acceleration step S421. In this case, the first acceleration current measuring step S410 may be conducted before the second RPM is reached. That is, the first acceleration current (As) is measured at the initial stage of the dehydration drying operation S40. In some implementations, the first acceleration current (As) is measured before the drum reaches 270 rpm. In these implementations, the first acceleration current (As) may be measured in the section between 120 RPM and 270 RPM. In the case that the first acceleration current measuring step S410 is conducted during the first acceleration step S421, the drum may be accelerated from the second RPM to the first RPM immediately after the first acceleration current measuring step S410 is conducted. For instance, the speed of the drum may be maintained at the second RPM for a predetermined time ($\Delta t_m$). Herein, the predetermined time ($\Delta t_m$) may be 5 seconds or 15 seconds.

Referring to FIG. 9, a second acceleration current measuring step may be conducted. In the second acceleration current measuring step, the total current consumed to accelerate the drum containing the laundry with a second acceleration for a second time is measured. The second acceleration current measuring step may be conducted in the first acceleration step S421. The second acceleration current measuring step may be conducted after the first acceleration current measuring step. That is, after the first acceleration current measuring step S410 is conducted, the second acceleration current measuring step may be conducted before termination of the first acceleration step S421. In other words, the total current may be measured in the section in which the drum is accelerated from the second RPM to the first RPM. Accordingly, the second acceleration current ($A_2$) may be measured in the section between 270 RPM and 450 RPM. The second time may be 38 seconds, and the second acceleration may be 3.4 rpm/s.

It will be apparent to those skilled in the art that various modifications and variations can be made without departing from the spirit or scope of the disclosure. Thus, it is intended that the present disclosure covers modifications and variations that come within the scope of the appended claims and their equivalents.

What is claimed is:

1. A method for controlling a laundry treating apparatus comprising:

determining at least one of a dryness level and a percentage of water content of laundry received in a drum of the laundry treating apparatus;

determining whether the laundry in the drum includes water-filled laundry based on at least one of the dryness level and the percentage of water content of the laundry in the drum; and controlling dehydration drying of the laundry in the drum based on the determination of whether the laundry in the drum includes water-filled laundry, wherein at least one of the dryness level and the percentage of water content of the laundry in the drum is calculated based on a current consumed to rotate the drum.

2. The method according to claim 1:

wherein determining at least one of the dryness level and the percentage of water content of laundry received in the drum of the laundry treating apparatus comprises determining the dryness level of laundry received in the drum of the laundry treating apparatus;

wherein determining whether the laundry in the drum includes water-filled laundry based on at least one of the dryness level and the percentage of water content of the laundry in the drum comprises:

comparing the dryness level of laundry received in the drum of the laundry treating apparatus to a reference dryness level;

based on comparison results, determining that the dryness level of laundry received in the drum of the laundry treating apparatus meets the reference dryness level; and based on the determination that the dryness level of laundry received in the drum of the laundry treating apparatus meets the reference dryness level, determining that the laundry received in the drum of the laundry treating apparatus does not include water-filled laundry; and wherein controlling dehydration drying of the laundry in the drum based on the determination of whether the laundry in the drum includes water-filled laundry comprises conducting a dehydration drying operation based on the determination that the laundry received in the drum of the laundry treating apparatus does not include water-filled laundry.

3. The method according to claim 2, wherein determining the dryness level of laundry received in the drum of the laundry treating apparatus comprises:

measuring an amount of the laundry in the drum in an environment in which the drum is not filled with water;

accelerating the drum to a reference revolutions per minute (RPM);

measuring inertia of the laundry in the drum based on acceleration of the drum to the reference RPM; and calculating the dryness level using the measured amount of the laundry in the drum and the measured inertia.

4. The method according to claim 3, wherein measuring the amount of the laundry in the drum in the environment in which the drum is not filled with water comprises measuring the amount of the laundry in the drum prior to a washing operation of removing contaminants from the laundry.

5. The method according to claim 4, wherein measuring the amount of the laundry in the drum in the environment in which the drum is not filled with water comprises:

measuring an initial-amount-of-laundry current, the initial-amount-of-laundry current representing a total current consumed to maintain the drum at a certain speed for sensing of an initial amount of laundry for a certain time; and setting the amount of the laundry in the drum based on the initial-amount-of-laundry current.

6. The method according to claim 3, wherein the measuring the amount of the laundry in the drum in the environment in which the drum is not filled with water comprises measuring a first amount of dehydrated laundry in the drum after draining water from the drum following a rinsing operation that removes a detergent from the laundry.

7. The method according to claim 6, wherein measuring the first amount of dehydrated laundry in the drum comprises measuring a first-amount-of-dehydrated-laundry current, the first-amount-of-dehydrated-laundry current representing a total current consumed to maintain the drum at a certain speed for sensing of the first amount of dehydrated laundry for a certain time, setting the first amount of dehydrated laundry in the drum based on the first-amount-of-dehydrated-laundry current.

8. The method according to claim 3, wherein measuring the amount of the laundry in the drum in the environment in which the drum is not filled with water comprises measuring a first acceleration current, the first acceleration current representing a total current consumed to accelerate the drum including supersaturated laundry at a first acceleration rate for a certain time, setting the amount of the laundry in the drum based on the first acceleration current.

9. The method according to claim 3, wherein measuring inertia of the laundry in the drum based on acceleration of the drum to the reference RPM comprises:

accelerating the drum including the laundry upon which a rinsing operation has been completed to a first RPM;

decelerating the drum to a second RPM lower than the first RPM;

measuring a reference current, the reference current representing a total current consumed to accelerate the drum from the second RPM at a reference acceleration rate for a reference time; and setting the inertia of the laundry in the drum based on the reference current.

10. The method according to claim 9, wherein measuring the amount of the laundry in the drum in the environment in which the drum is not filled with water comprises:

measuring a first acceleration current during acceleration of the drum including the laundry upon which the rinsing operation has been completed to the first RPM, the first acceleration current representing a total current consumed to accelerate the drum including supersaturated laundry at a first acceleration rate for a certain time; and setting the amount of the laundry in the drum based on the first acceleration current.

11. The method according to claim 10, wherein measuring the first acceleration current is conducted in a range of rate of rotation lower than the second RPM.

12. The method according to claim 1:

wherein determining at least one of the dryness level and the percentage of water content of laundry received in the drum of the laundry treating apparatus comprises determining the percentage of water content of laundry received in the drum of the laundry treating apparatus;

wherein determining whether the laundry in the drum includes water-filled laundry based on at least one of the dryness level and the percentage of water content of the laundry in the drum comprises:

comparing the percentage of water content of laundry received in the drum of the laundry treating apparatus to a reference percentage of water content;

based on comparison results, determining that the percentage of water content of laundry received in the drum of the laundry treating apparatus does not meet the reference percentage of water content; and based on the determination that the percentage of water content of laundry received in the drum of the laundry treating apparatus does not meet the reference percentage of water content, determining that the laundry received in the drum of the laundry treating apparatus does not include water-filled laundry; and wherein controlling dehydration drying of the laundry in the drum based on the determination of whether the laundry in the drum includes water-filled laundry comprises conducting a dehydration drying operation based on the determination that the laundry received in the drum of the laundry treating apparatus does not include water-filled laundry.

13. The method according to claim 12, wherein determining the percentage of water content of laundry received in the drum of the laundry treating apparatus comprises:

prior to a washing operation of removing contaminants from the laundry in the drum, measuring an initial amount of the laundry in the drum;

measuring a first amount of dehydrated laundry after draining water from the drum following a rinsing operation that removes a detergent from the laundry; and calculating the percentage of water content using the initial amount of laundry and the first amount of dehydrated laundry.

14. The method according to claim 13, wherein measuring an initial amount of the laundry in the drum comprises:

measuring an initial-amount-of-laundry current, the initial-amount-of-laundry current representing a total current consumed to maintain the drum at a certain speed for sensing of the initial amount of laundry for a certain time; and setting the initial amount of the laundry in the drum based on the initial-amount-of-laundry current.

15. The method according to claim 13, wherein measuring the first amount of dehydrated laundry comprises:

measuring a first-amount-of-dehydrated-laundry current, the first-amount-of-dehydrated-laundry current representing a total current consumed to maintain the drum at a certain speed for sensing of the first amount of dehydrated laundry for a certain time; and setting the first amount of dehydrated laundry based on the first-amount-of-dehydrated-laundry current.

16. The method according to claim 13, wherein measuring the first amount of dehydrated laundry comprises:

measuring a first acceleration current, the first acceleration current representing a total current consumed to accelerate the drum including supersaturated laundry at a first acceleration rate for a certain time; and setting the first amount of dehydrated laundry based on the first acceleration current.

17. The method according to claim 2, wherein a range of the dryness level is divided into a plurality of dryness level sections that correspond to a different rate of rotation of the drum in each of the dryness level sections, and wherein conducting the dehydration drying operation comprises:

determining, from among the plurality of dryness level sections, a dryness level section based on the dryness level of laundry received in the drum of the laundry treating apparatus; and conducting the dehydration drying operation using a rate of rotation of the drum that corresponds to the determined dryness level section.

18. The method according to claim 17, wherein the rate of rotation of the drum is determined such that the rate of rotation is in proportion to the dryness level.

19. The method according to claim 17:

wherein determining at least one of the dryness level and the percentage of water content of laundry received in the drum of the laundry treating apparatus comprises determining the dryness level of laundry received in the drum of the laundry treating apparatus;

wherein determining whether the laundry in the drum includes water-filled laundry based on at least one of the dryness level and the percentage of water content of the laundry in the drum comprises:

comparing the dryness level of laundry received in the drum of the laundry treating apparatus to a reference dryness level;

based on comparison results, determining that the dryness level of laundry received in the drum of the laundry treating apparatus does not meet the reference dryness level; and based on the determination that the dryness level of laundry received in the drum of the laundry treating apparatus does not meet the reference dryness level, determining that the laundry received in the drum of the laundry treating apparatus includes water-filled laundry; and wherein controlling drying of the laundry in the drum based on the determination of whether the laundry in the drum includes water-filled laundry comprises performing an operation directed to eliminating water-filled laundry from the drum.

20. The method according to claim 19, further comprising:

counting a number of times of determining that the dryness level does not meet the reference dryness level;

comparing the number of times to a reference number;

based on the comparison of the number of times to the reference number, determining whether the number of times meets the reference number;

terminating a dehydration drying operation based on a determination that the number of times meets the reference number; and based on a determination that the number of times does not meet the reference number:

repeating the operation directed to eliminating water-filled laundry from the drum, and repeating determination of the dryness level of laundry received in the drum of the laundry treating apparatus.

21. The method according to claim 19, wherein the operation directed to eliminating water-filled laundry from the drum comprises performing at least one of forward rotation and reverse rotation of the drum in an attempt to untangle laundry in the drum.

22. The method according to claim 21, wherein the operation directed to eliminating water-filled laundry from the drum further comprises supplying washing water to a tub prior to performing at least one of forward rotation and reverse rotation of the drum in an attempt to untangle laundry in the drum.

* * * * *